US006952149B2

(12) United States Patent
Ciarcia et al.

(10) Patent No.: US 6,952,149 B2
(45) Date of Patent: Oct. 4, 2005

(54) APPARATUS FOR INTERRUPTING A SHORT CIRCUIT IN A CIRCUIT BREAKER

(75) Inventors: Ronald Ciarcia, Bristol, CT (US); Ananthram Subramanian, Secunderabad (IN); Macha Narender, Chikkadapally (IN); Luis Brignoni, Toa Baja, PR (US); Samuel Kim, Bristol, CT (US)

(73) Assignee: General Electric Company, Schenectady, NY (US)

( * ) Notice: Subject to any disclaimer, the term of this patent is extended or adjusted under 35 U.S.C. 154(b) by 1 day.

(21) Appl. No.: 10/436,643

(22) Filed: May 13, 2003

(65) Prior Publication Data

US 2004/0227603 A1 Nov. 18, 2004

(51) Int. Cl.[7] ..... H01H 75/00
(52) U.S. Cl. ..... 335/16; 335/147; 335/195
(58) Field of Search ..... 335/6, 16, 147, 335/195, 202, 165–176; 218/22; 200/244

(56) References Cited

U.S. PATENT DOCUMENTS 4,649,247 A * 3/1987 Preuss et al. ..... 200/244
4,963,849 A * 10/1990 Kowalczyk et al. ..... 335/201

* cited by examiner

*Primary Examiner*—Lincoln Donovan
(74) *Attorney, Agent, or Firm*—Cantor Colburn LLP

(57) ABSTRACT

A circuit breaker includes a housing, an operating mechanism, and a cassette. The cassette includes a separable current path having a movable contact arm, two arc receptors each disposed for receiving an electrical arc in response to a short circuit overcurrent condition, and two slot motors each disposed proximate the movable contact arm for magnetically driving the movable contact arm to a blown open position in response to a short circuit overcurrent condition. The slot motors each have two side legs opposing each other and defining a space therebetween for receiving the movable contact arm, each side leg having a magnetic core and an insulative layer and being biased toward the interior of the side walls of the cassette, wherein each side leg is restrained from being magnetically attracted toward the movable contact arm during a short circuit condition.

17 Claims, 5 Drawing Sheets

APPARATUS FOR INTERRUPTING A SHORT CIRCUIT IN A CIRCUIT BREAKER

BACKGROUND OF THE INVENTION

The present disclosure relates generally to an apparatus for interrupting a short circuit in a circuit breaker, and particularly to a cassette having a slot motor and line strap arrangement for enhancing short circuit interruption performance.

Circuit breakers are used today in electrical distribution systems for protecting electrical circuits, and may be single-phase or multi-phase devices having a variety of ampere and voltage ratings, such as 15–1200 amps at 120–600 volts ac or 500 Volts DC for example. To respond to a short circuit condition, circuit breakers employ trip units, which may be thermal, magnetic, pressure actuated, or electronic in nature, and may be coupled to contact arms that are of a blow open or non-blow open arrangement. With blow open contact arm arrangements, a short circuit condition causes the contact arms to blow open independent of the circuit breaker operating mechanism and independent of the trip unit action. Advancements in circuit breaker design has led to an arrangement of modular cassettes having blow open contact arms, with each cassette being contained within a circuit breaker housing, and with each cassette being in operable communication with an electronic trip or mechanical Thermal/Magnetic trip unit and an operating mechanism. The blow open contact arm arrangement provides for a rapid response to a short circuit condition, while the electronic trip unit or mechanical trip unit arrangement provides for a multi-functional tripping device. However, as market demands increase, so do the demands on short circuit interruption performance. Accordingly, there is a need for advances in the field of short circuit interruption technology where a blow open contact arm can more rapidly respond to the onset of a short circuit fault condition.

SUMMARY OF THE INVENTION

In one embodiment, a circuit breaker includes a housing, an operating mechanism, and a cassette. The cassette includes a separable current path having a movable contact arm, two arc receptors each disposed for receiving an electrical arc in response to a short circuit overcurrent condition, and two slot motors each disposed proximate the movable contact arm for magnetically driving the movable contact arm to a blown open position in response to a short circuit overcurrent condition. The slot motors each have two side legs opposing each other and defining a space therebetween for receiving the movable contact arm, each side leg having a magnetic core and an insulative layer and being biased toward the interior of the side walls of the cassette, wherein each side leg is restrained from being magnetically attracted toward the movable contact arm during a short circuit condition.

In another embodiment, a circuit breaker includes an operating mechanism disposed within a housing and a cassette. The cassette includes a separable current path and a slot motor proximate the separable current path for magnetically opening the separable current path during a short circuit condition. The slot motor includes side legs with a hole each, and the cassette includes side walls with holes aligned with the holes of the slot motor side legs. Securing hardware installed through the aligned holes biases each slot motor side leg toward the interior of the side wall of the cassette, wherein each slot motor side leg is restrained from being magnetically attracted toward the separable current path during a short circuit condition.

In a further embodiment, a cassette for a circuit breaker includes a separable current path, and a slot motor disposed proximate the separable current path for magnetically opening the separable current path during a short circuit condition. The slot motor includes side legs and means for biasing each side leg toward an interior side wall of the cassette, wherein each slot motor side leg is restrained from being magnetically attracted toward the separable current path during a short circuit condition.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the present invention provides a cassette-type double-break circuit breaker with an interrupter having a slot motor and a line strap arrangement for effective interruption under short circuit conditions. As used herein, the term double-break refers to an interrupter construction that has two interrupter chambers 250 with near identical geometry, with the primary difference being in the end geometry of the conductor straps to accommodate line side or load side mounting of the circuit breaker. Also as used herein, the term magnetic material refers to any material exhibiting ferromagnetic characteristics when placed in the vicinity of an electrical current, such characteristics serving to provide a magnetic path of reduced magnetic reluctance with respect to the reluctance of free space.

Figure 1:
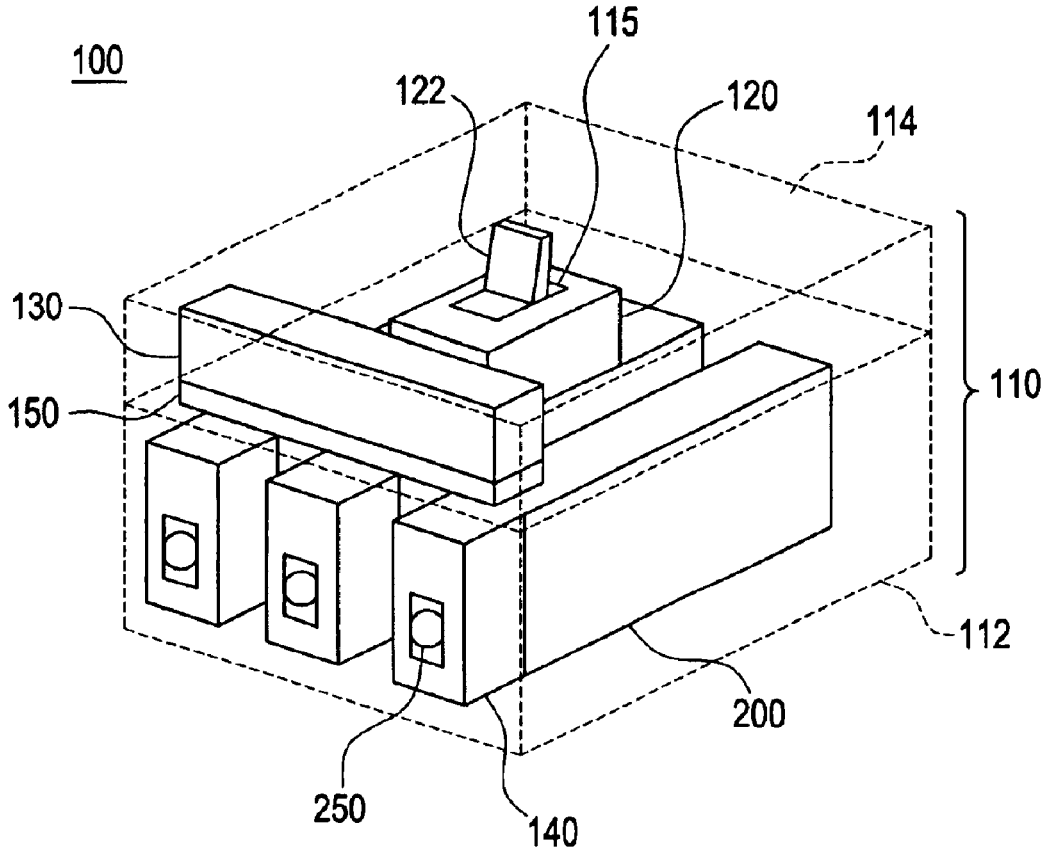
FIG. 1 depicts an isometric view of a circuit breaker for implementing an embodiment of the invention.
Figure 2:
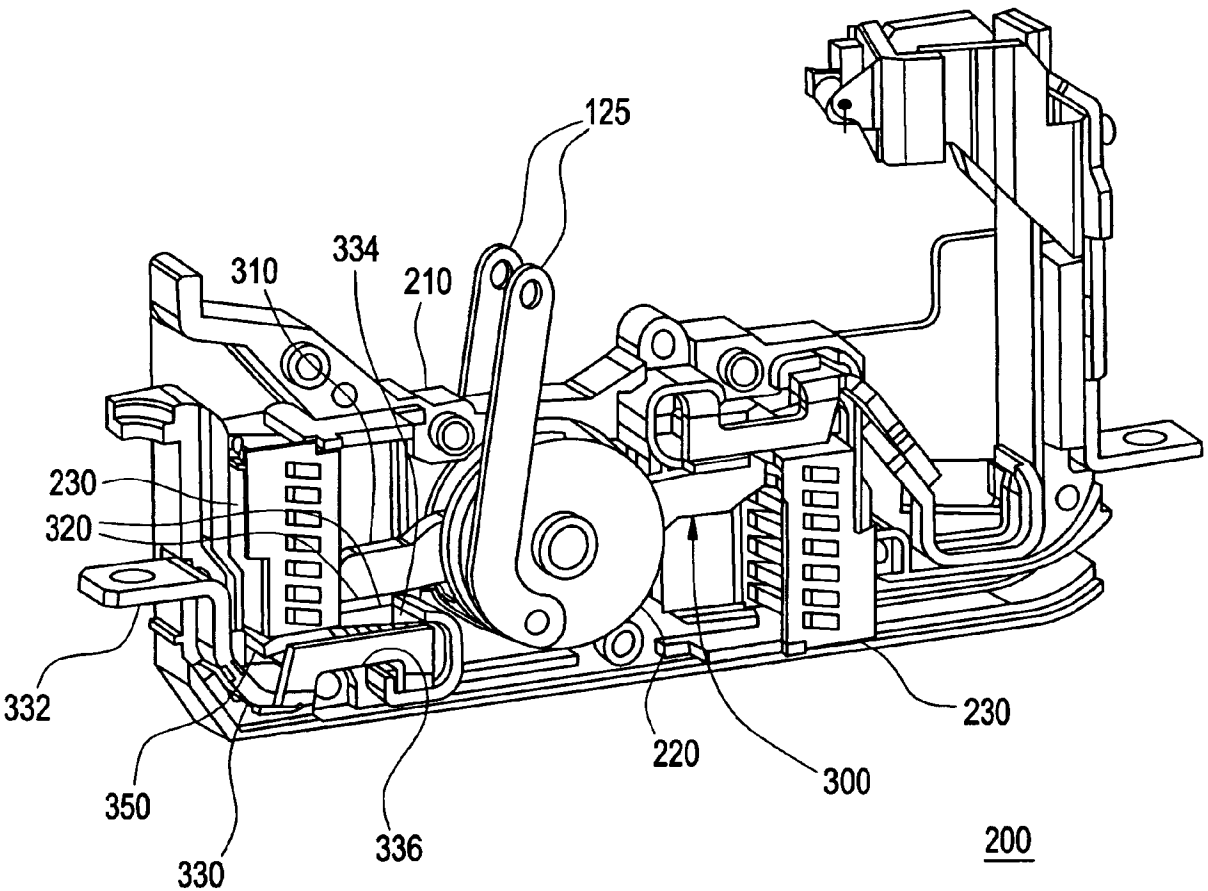
FIG. 2 depicts an isometric view of a cassette with one side wall removed for implementing an embodiment of the invention in the circuit breaker of FIG. 1.
Figure 3:
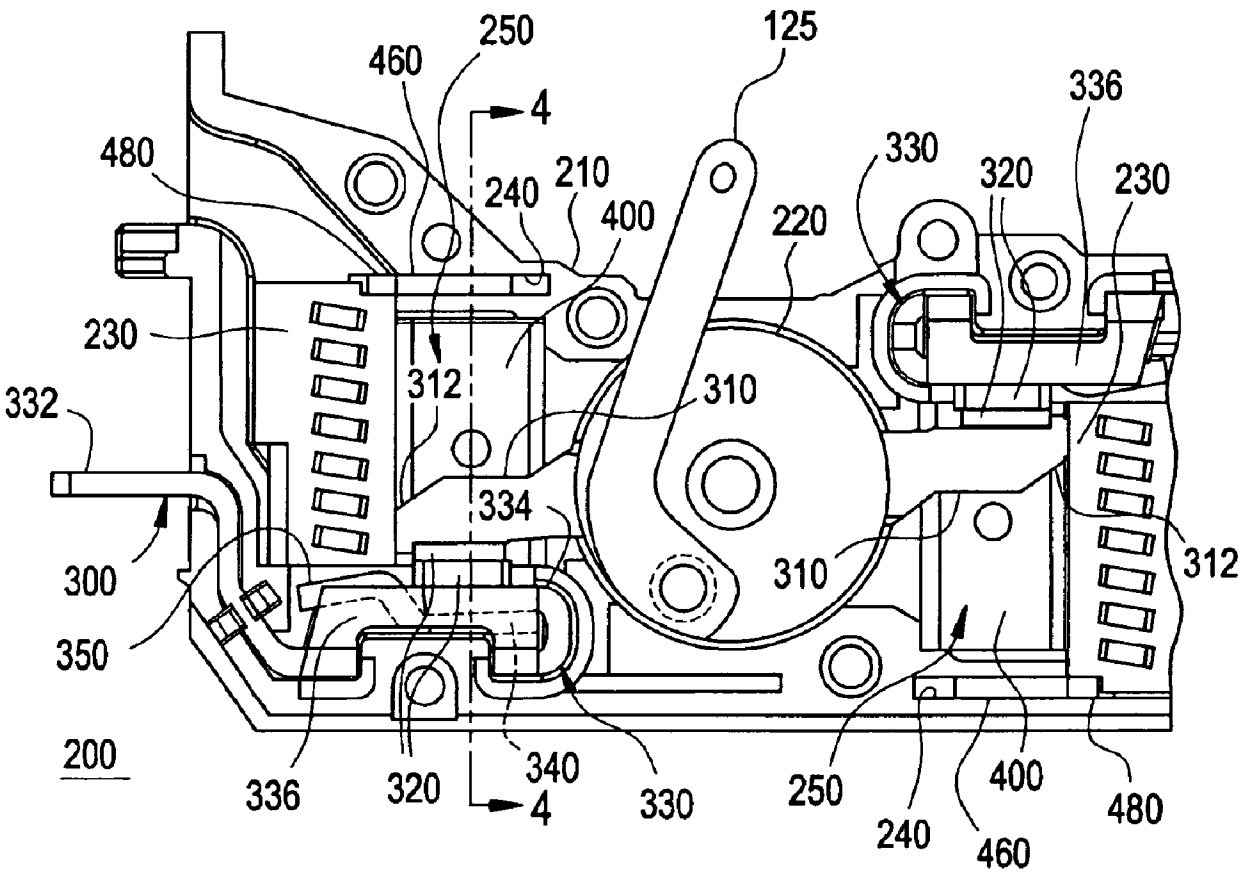
FIG. 3 depicts a side planar view of the cassette of FIG. 2 in accordance with an embodiment of the invention.

Referring now to FIG. 1, an exemplary embodiment of a circuit breaker 100 is depicted having a housing 110 with an aperture 115, an operating mechanism 120 with an operating handle 122 disposed through aperture 115 for actuating operating mechanism 120, and an interrupter cassette 200 in operable communication with operating mechanism 120 via a drive arm 125 for opening and closing a separable current path 300, best seen by referring to FIGS. 2 and 3. Operating mechanism 120 may be of any type suitable for opening and closing separable current path 300, and may be mechanical, electromagnetic, or pneumatic in construction.

Referring now to FIGS. 2 and 3, interrupter cassette 200 includes side walls 210 (one shown and one removed for clarity), and separable current path 300 operatively connected to operating mechanism 120 via a rotor 220 and drive arm 125. Separable current path 300 includes a movable contact arm 310, two separable contact pairs 320 (one pair at each end of contact arm 310), and two generally U-shaped conductor straps 330 (one at each end of contact arm 310).

Arc receptors 230, such as steel plate arc chutes for example, are disposed at each end of movable contact arm 310 for receiving an electrical arc generated between contact pairs 320 in response to a short circuit overcurrent condition separating separable current path 300. Movable contact arm 310 is positionable in a closed position, as shown in FIGS. 2 and 3, an open position in response to the action of operating mechanism 120, and a blown open position in response to magnetic repulsion forces generated during a short circuit overcurrent condition. In response to a blow open action, movable contact arm 310 rotates to an open position independent of operating mechanism 120 and rotor 220. During a short circuit condition, interruption of the electrical arc occurs at interrupter chamber 250, with one chamber being located at each end of movable contact arm 310.

Figure 4:
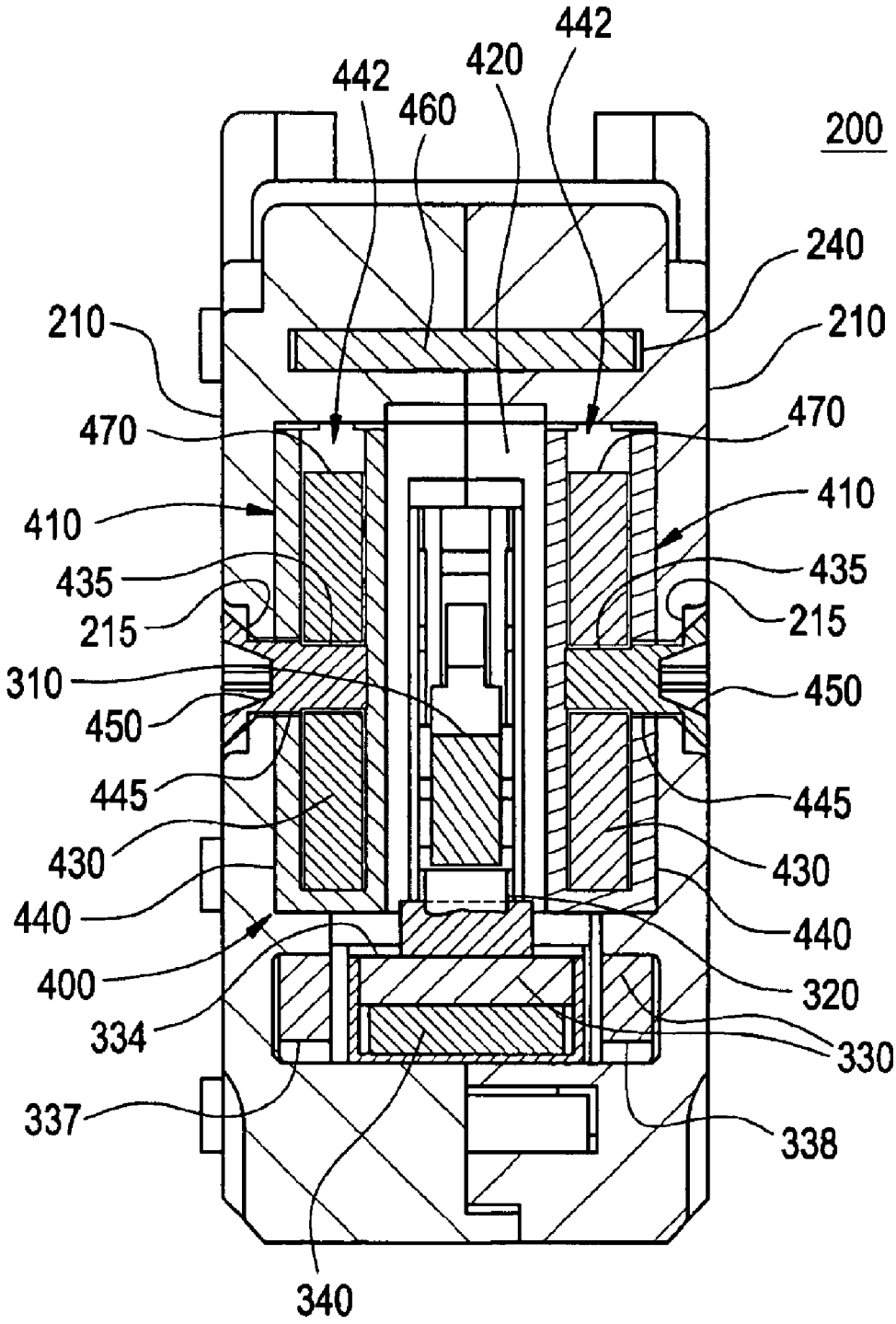
FIG. 4 depicts a cross sectional view of the cassette of FIG. 3.

To assist in the blow open action of movable contact arm 310, two slot motors 400 are employed, best seen by referring now to FIGS. 3 and 4 where FIG. 4 depicts a cross section view through Section 4-4 of FIG. 3, with one slot motor 400 being disposed at each end of movable contact arm 310. Each slot motor 400 includes two side legs 410 that oppose each other and define a space 420 therebetween for receiving movable contact arm 310. Each side leg 410 has a magnetic core 430 and an insulative pocket 440 for providing an insulative layer to prevent arcing to magnetic core 430, and each side leg 410 is biased toward the interior of side wall 210 of cassette 200 via securing hardware 450, as will be discussed in more detail below, thereby restraining side legs 410 from being magnetically attracted toward movable contact arm 310 during a short circuit condition. In an embodiment, insulative pocket 440 has five sides (three sides shown in the cross section view of FIG. 4, with the two other sides arranged in the plane of the paper but either hidden from view or removed by the section cut) and an open end 442. During assembly, open end 442 receives magnetic core 430, which is subsequently secured in place by securing hardware 450 that passes through a hole 445 in the outermost side of the five-sided pocket 440.

In circuit breakers having a cassette-type construction, which are compact in form, it is beneficial to bias side legs 410 of slot motor 400 toward side walls 210 for at least two reasons: to avoid any displacement of side legs 410 toward movable contact arm 310 during a short circuit condition where magnetic forces may attract magnetic core 430 to movable contact arm 310 thereby causing friction and reduced opening speed; and, to take up dimensional tolerances on one side of magnetic core 430 thereby maximizing the thickness of steel that can be used in magnetic core 430 for improved opening speed. The more ferromagnetic material that can be used in slot motor 400, the more effective slot motor 400 will be for driving movable contact arm 310 open during a short circuit interruption.

In an embodiment, side legs 410 are biased toward side walls 210 by way of securing hardware 450, such as a screw for example, however, it is also contemplated that other securing hardware such as a rivet may be employed. With regard to the use of a screw 450, magnetic core 430 includes a threaded hole 435 into which screw 450 is fastened. To accept screw 450, insulative pockets 440 have hole 445 and side walls 210 of cassette 200 have a hole 215. In an embodiment, hole 215 in side wall 210 is a counterbore hole thereby providing a seat for a shouldered screw to fasten to. Holes 435, 445 and 215 are properly aligned for assembly.

To further assist in the blow open speed of movable contact arm 310, additional ferromagnetic material may be used across the top (as depicted in FIG. 4) of slot motor 400 in the form of a lateral leg 460, which is positioned in a pocket 240 of cassette 200 to insulate lateral leg 460 from arcing during short circuit. As can be seen from FIGS. 3 and 4, lateral leg 460 is disposed at and extending between opposing edges 470 of magnetic core 430, thereby providing a magnetic path from one side leg 410 to the other. In alternative embodiments, lateral leg 460 may be planar, as depicted in FIG. 4, or U-shaped to cooperate with open ends 442 of insulative pocket 440 and abut edges 470 of magnetic core 430. As described, magnetic cores 430 of side legs 410, and lateral leg 460 define a generally U-shaped magnetic circuit with the closed end of the U-shape disposed proximate movable contact arm 310 in the blown open position, and with the open end of the U-shaped magnetic circuit disposed proximate U-shaped conductor straps 330.

In an embodiment, lateral leg 460 may have a portion 480 that is not protected by the insulation material of pocket 240 of cassette 200, and since portion 480 is proximate arc receptor 230 and proximate the end 312 of movable contact arm 310 in the blown open position, it will be receptive to an electrical arc during a short circuit condition, thereby further enhancing the interruption process by stretching the electrical arc toward the upper most section of arc receptor 230.

In an alternative embodiment, the blow open speed of movable contact arm 310 is further enhanced by the geometry of U-shaped conductor straps 330. Referring now to FIGS. 2–4 collectively, conductor strap 330 includes a connector portion 332, a contact portion 334, and a bifurcated portion 336 disposed therebetween, where bifurcated portion 336 includes first and second conductor paths 337, 338, best seen by referring to FIG. 4. Connector portion 332, bifurcated portion 336, and movable contact arm 310 are all arranged to provide current flow in the same direction (a first direction, such as into the page with reference to FIG. 4), and contact portion 334 is arranged to provide current flow in the opposite direction (a second direction, such as out of the page with reference to FIG. 4). In this arrangement and under a short circuit condition, the magnetic field created by the current flow in contact portion 334 acts to repel movable contact arm 310 (as a result of the reverse loop of current in the current path), and the magnetic filed created by the current flow in bifurcated portion 336 acts to attract movable contact arm 310 (as a result of the same direction of current in the current path). However, with the current flow in bifurcated portion 336 being arranged outboard of the current flow in contact portion 334, best seen in FIG. 4, the magnetic field created by the current flow in contact portion 334 acting to repel movable contact arm 310 is substantially greater than the combined magnetic field created by the current flow in bifurcated portion 336 acting to attract movable contact arm 310, thereby enhancing the blow open performance of cassette 200.

In a further alternative embodiment, the blow open speed of movable contact arm 310 may be further enhanced by introducing a flux concentrator 340, made of magnetic material, underneath contact portion 334 of conductor strap 330, thereby enhancing the magnetic field associated with the current flow in contact portion 334 which acts to repel movable contact arm 310 at short circuit. In alternative embodiments, flux concentrator 340 may be planar, as depicted in FIG. 4, or U-shaped to partially surround contact portion 334 of conductor strap 330. By extending flux concentrator 340 to provide an arc runner portion 350 that extends beyond the end of contact portion 334 toward arc receptor 230, the electrical arc will be attracted from contact portion 334 toward arc runner portion 350 and toward arc receptor 230 during a short circuit condition, thereby further enhancing the interruption performance of cassette 200.

Figure 6:
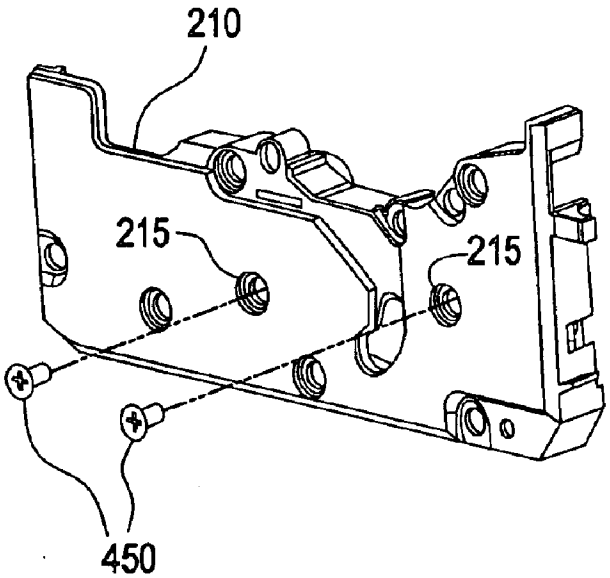
FIG. 6 depicts an exemplary attachment arrangement for the interrupter chamber of FIG. 5.
Figure 5:
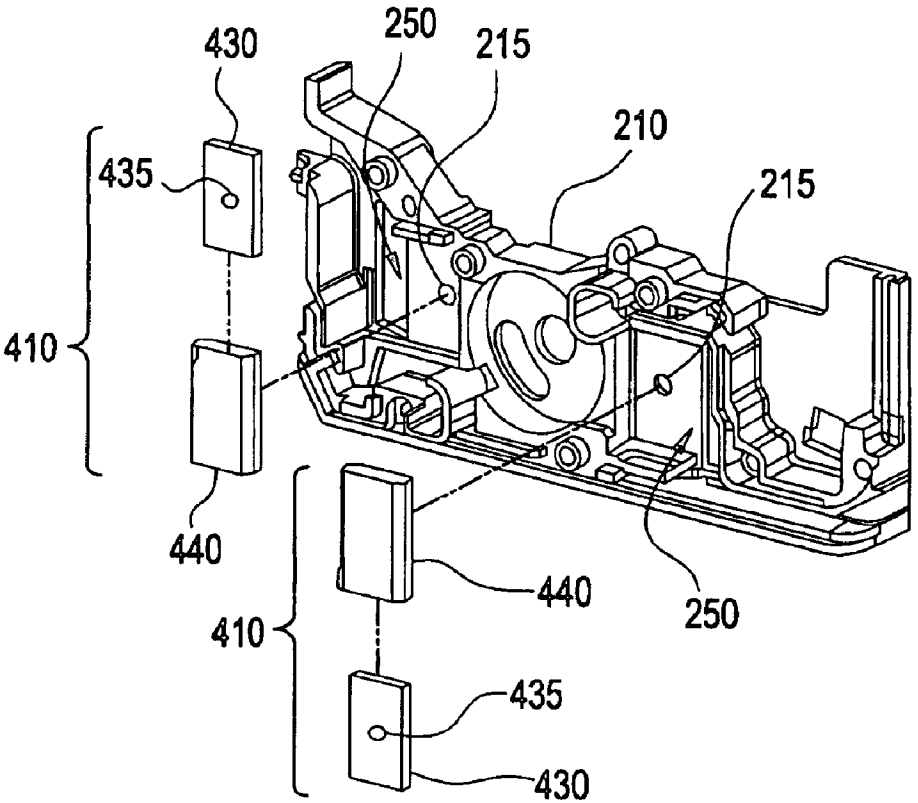
FIG. 5 depicts a partial exploded assembly view of an interrupter chamber in accordance with an embodiment of the invention.

Referring now to FIGS. 5 and 6, side wall 210 of cassette 200 is depicted from both sides, where the components of the separable current path 310 have been removed and one side leg 410 for each interrupter chamber 250 is shown in an exploded assembly view. As depicted, screws 450 securely fasten side legs 410 toward side wall 210 via threaded hole 435.

During a short circuit condition, current passes through separable current path 300 by passing through connector portion 332 of conductor strap 330 in a first direction, through bifurcated portion 336 in the same first direction, through contact portion 334 in a second reverse direction, across contact pairs 320 to reverse direction again through movable contact arm 310 back to the first direction, and through the second U-shaped conductor strap 330 at the other end of movable contact arm 310 in a similar manner. At short circuit, the magnetic field generated by the convoluted current path is enhanced by the magnetic characteristics of flux concentrator 340, magnetic cores 430 of slot motor side legs 410, and lateral leg 460, thereby enhancing the magnetic blow open force acting on movable contact arm 310.

In view of the foregoing, some embodiments of the invention have some of the following advantages: enhanced blow open speed of the movable contact arm during a short circuit interruption condition; enhanced propagation of the electrical arc into the arc chute during a short circuit interruption condition; and, reduced let-through current at short circuit in response to rapid generation of contact gap, rapid generation of arc voltage, and enhanced current limiting.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A circuit breaker, comprising:

a housing;

an operating mechanism operable from outside of the housing;

a cassette having side walls and operatively connected to the operating mechanism, the cassette comprising:

a separable current path having a movable contact arm and two contact pairs, the movable contact arm responsive to the operating mechanism and a short circuit overcurrent condition and positionable in a closed position, an open position, and a blown open position;

two arc receptors each disposed for receiving an electrical arc at each of the two contact pairs in response to a short circuit overcurrent condition separating the separable current path; and two slot motors each disposed proximate the movable contact arm for magnetically driving the movable contact arm to the blown open position in response to a short circuit overcurrent condition, the slot motors each having two side legs opposing each other and defining a space therebetween for receiving the movable contact arm, each side leg having a magnetic core and an insulative layer and being biased toward the interior of the side walls of the cassette;

wherein each side leg is restrained from being magnetically attracted toward the movable contact arm during a short circuit condition.

2. The circuit breaker of claim 1, wherein each slot motor further comprises:

a lateral leg disposed at and extending between opposing edges of the two side legs, the lateral leg having a magnetic core and an insulative layer and disposed to provide a magnetic path from one side leg to the other;

wherein the two side legs and lateral leg define a general U-shaped magnetic circuit with the closed end proximate the movable contact arm in the blown open position.

3. The circuit breaker of claim 2, wherein:

the lateral leg has an uninsulated section proximate the arc receptor and proximate the end of the movable contact arm in the blown open position for receiving an electrical arc during a short circuit condition.

4. The circuit breaker of claim 1, wherein the separable current path further comprises:

two conductor straps one disposed at each end of the movable contact arm for providing a line to load current path in response to the movable contact arm being in the closed position;

each conductor strap comprising a general U-shape, a connector portion, and contact portion, and a bifurcated portion:

wherein the bifurcated portion and the movable contact arm are adapted to provide current flow in a first direction, and the contact portion is adapted to provide current flow in a second and opposite direction;

wherein the magnetic field created by the current flow in contact portion acting to repel the movable contact arm is substantially greater than the combined magnetic field created by the current flow in the bifurcated portion acting to attract the movable contact arm.

5. The circuit breaker of claim 4, further comprising:

a flux concentrator disposed at each conductor strap on the side of the contact portion opposite that of the movable contact arm, the flux concentrator being made of a magnetic material;

wherein the magnetic field created by the current flow in the contact portion is intensified by the presence of the flux concentrator.

6. The circuit breaker of claim 5, wherein:

the flux concentrator includes an arc runner portion extending from the contact portion of the conductor strap toward the arc receptor;

wherein an electrical arc is attracted from the contact portion toward the arc runner portion and the arc receptor during a short circuit condition.

7. The circuit breaker of claim 1, wherein:

each magnetic core and each cassette side wall includes a hole aligned with each other for receiving biasing hardware to bias each side leg of the slot motor toward the interior of each side wall of the cassette.

8. The circuit breaker of claim 7, wherein the hole in each magnetic core comprises threads, and further comprising:

a screw disposed through each hole in the cassette side wall and fastened to the threaded hole of each magnetic core.

9. The circuit breaker of claim 6, wherein each slot motor further comprises:

a lateral leg disposed at and extending between opposing edges of the two side legs, the lateral leg having a magnetic core, an insulative layer and an uninsulated section proximate the arc receptor and proximate the end of the movable contact arm in the blown open position, the uninsulated section for receiving an electrical arc during a short circuit condition;

wherein the two side legs and lateral leg define a general U-shaped magnetic circuit with the closed end and insulative layer proximate the movable contact arm in the blown open position.

10. A circuit breaker, comprising:

an operating mechanism disposed within a housing;

a cassette having a separable current path in operable communication with the operating mechanism;

a slot motor disposed within the cassette and proximate the separable current path for magnetically opening the separable current path during a short circuit condition;

wherein the slot motor includes side legs each having a hole;

wherein the cassette includes side walls each having a through hole aligned with a hole of an associated slot motor side leg; and securing hardware installed through the aligned holes and biasing each slot motor side leg toward the interior of the associated side wall of the cassette;

wherein each slot motor side leg is restrained from being magnetically attracted toward the separable current path during a short circuit condition.

11. The circuit breaker of claim 10, wherein:

the separable current path comprises a movable contact arm and a U-shaped conductor strap disposed at each end of the movable contact arm, the U-shaped conductor strap having a contact portion and a bifurcated portion, the contact portion arranged for enhancing the magnetic repulsion force and the bifurcated portion arranged for reducing the magnetic attractive force acting on the movable contact arm during a short circuit condition.

12. The circuit breaker of claim 11, wherein each slot motor further comprises:

a lateral leg disposed at and extending between opposing edges of the two side legs thereby defining a generally U-shaped magnetic circuit with the open end proximate one of the U-shaped conductor straps, the lateral leg including an uninsulated portion proximate the end of the movable contact arm in a blown open position for receiving an electrical arc during a short circuit condition.

13. The circuit breaker of claim 11, further comprising:

a flux concentrator disposed at each U-shaped conductor strap on the side of the contact portion opposite that of the movable contact arm, the flux concentrator including an arc runner portion extending from the end of the contact portion of the U-shaped conductor strap;

wherein the magnetic field created by the current flow in the contact portion is intensified by the presence of the flux concentrator, and an electrical arc is attracted from the contact portion toward the arc runner portion during a short circuit condition.

14. A cassette for a circuit breaker, comprising:

a separable current path;

a slot motor disposed proximate the separable current path for magnetically opening the separable current path during a short circuit condition, the slot motor including side legs; and means for biasing each side leg toward an interior side wall of the cassette;

wherein each slot motor side leg is restrained from being magnetically attracted toward the separable current path during a short circuit condition.

15. The cassette of claim 14, wherein each side leg of the slot motor has a hole, and each cassette side wall has a through hole aligned with the hole of an associated slot motor side leg, and further comprising:

securing hardware installed through the aligned holes and biasing each slot motor side leg toward the interior side wall of the cassette.

16. The cassette of claim 15, wherein the slot motor leg comprises:

an insulative pocket having five sides and a hole through one of the sides; and a magnetic core disposed within the insulative pocket, the magnetic core having a hole aligned with the hole of the side of the pocket.

17. The cassette of claim 16, wherein the hole of the core is threaded and the securing hardware is a screw.

* * * * *

UNITED STATES PATENT AND TRADEMARK OFFICE

CERTIFICATE OF CORRECTION

PATENT NO. : 6,952,149 B2
DATED : October 4, 2005
INVENTOR(S) : Ciarcia et al.

It is certified that error appears in the above-identified patent and that said Letters Patent is hereby corrected as shown below:

Column 1,
Lines 18, 21 and 37, delete “blow” and insert -- blown --.

Column 3,
Lines 10, 17 and 65, delete “blow” and insert -- blown --.

Column 4,
Lines 25, 52 and 54, delete “blow” and insert -- blown --.
Line 42, delete “filed” and insert -- field --.

Column 5,
Lines 22 and 26, delete “blow” and insert -- blown --.

Signed and Sealed this

Twenty-first Day of March, 2006

JON W. DUDAS
*Director of the United States Patent and Trademark Office*